US011175617B2

(12) United States Patent
Motegi

(10) Patent No.: US 11,175,617 B2
(45) Date of Patent: Nov. 16, 2021

(54) IMAGE FORMING APPARATUS AND NON-TRANSITORY COMPUTER READABLE MEDIUM

(71) Applicant: FUJIFILM BUSINESS INNOVATION CORP., Tokyo (JP)

(72) Inventor: Yuma Motegi, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/985,702

(22) Filed: Aug. 5, 2020

(65) Prior Publication Data

US 2021/0302884 A1 Sep. 30, 2021

(30) Foreign Application Priority Data

Mar. 24, 2020 (JP) ..... JP2020-052153

(51) Int. Cl.
*G03G 15/08* (2006.01)
*G03G 15/00* (2006.01)

(52) U.S. Cl.
CPC ..... *G03G 15/5041* (2013.01); *G03G 15/0853* (2013.01); *G03G 15/6552* (2013.01)

(58) Field of Classification Search
USPC ..... 399/49
See application file for complete search history.

(56) References Cited

U.S. PATENT DOCUMENTS

2015/0205223 A1* 7/2015 Sato ..... G03G 15/043 347/118
2015/0338762 A1* 11/2015 Nakagawa ..... G03G 15/043 399/51

FOREIGN PATENT DOCUMENTS

JP 2015-135399 A 7/2015
JP 2018-066901 A 4/2018

* cited by examiner

*Primary Examiner* — Q Grainger
(74) *Attorney, Agent, or Firm* — Oliff PLC

(57) ABSTRACT

An image forming apparatus includes an image carrier, an exposure device, a developer image forming unit, a memory, and a processor. The image carrier carries a developer image. The exposure device exposes the image carrier. The developer image forming unit forms the developer image by transporting a developer to a latent image formed on the image carrier. The processor generates correction data for correcting density unevenness in a main scanning direction detected based on an image generated by the developer image, corrects the density unevenness in the main scanning direction occurring in the developer image by changing an exposure amount when the image carrier is exposed by the exposure device, using the generated correction data, and when a position change of the developer image forming unit in the main scanning direction is detected, adjusts the correction data by a detected position change amount.

8 Claims, 17 Drawing Sheets

PERSPECTIVE VIEW OF DEVELOPING ROLLER 157

RELATIONSHIP BETWEEN SURFACE POTENTIAL OF PHOTOCONDUCTOR DRUM 152 AND SURFACE POTENTIAL OF DEVELOPING ROLLER 157

FIRST METHOD OF FORMING AXIAL POSITION DETECTION IMAGE 80

SECOND METHOD OF FORMING AXIAL POSITION DETECTION IMAGE 80

DENSITY CORRECTION IN FORMING IMAGE

IMAGE FORMING APPARATUS AND NON-TRANSITORY COMPUTER READABLE MEDIUM

CROSS-REFERENCE TO RELATED APPLICATIONS

This application is based on and claims priority under 35 USC 119 from Japanese Patent Application No. 2020-052153 filed Mar. 24, 2020.

BACKGROUND

1. Technical Field

The present disclosure relates to an image forming apparatus and a non-transitory computer readable medium.

2. Related Art

JP-A-2015-135399 discloses an image forming apparatus that controls an amount of light emitted from LED elements to uniformize density unevenness in a main scanning direction generated by fluctuations in an amount of developer adhering to a photoconductor drum.

JP-A-2018-066901 discloses an image forming apparatus that calculates correction information of a developing bias by forming a test image and detecting a density of the test image, forms the test image again using the calculated correction information of the developing bias, and corrects density unevenness in a main scanning direction by correcting an exposure amount of an exposure device when the density unevenness in the formed test image is not within a predetermined allowable range.

SUMMARY

Aspects of non-limiting embodiments of the present disclosure relate to an image forming apparatus and a non-transitory computer readable medium capable of preventing a situation in which density unevenness in a developer image and a change in an exposure amount do not match even when the exposure amount of an exposure device is changed to correct the density unevenness in the main scanning direction in the developer image formed on an image carrier in a state where a position of a developer image forming unit that transports a developer onto the image carrier to form the developer image is deviated in the main scanning direction.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including an image carrier, an exposure device, a developer image forming unit, a memory, and a processor. The image carrier is configured to carry a developer image. The exposure device is configured to expose the image carrier. The developer image forming unit is configured to form the developer image by transporting a developer to a latent image formed on the image carrier by exposing the image carrier by the exposure device. The processor is configured to generate correction data for correcting density unevenness in a main scanning direction detected based on an image generated by the developer image formed on the image carrier by the developer image forming unit, correct the density unevenness in the main scanning direction occurring in the developer image by changing an exposure amount when the image carrier is exposed by the exposure device, using the generated correction data, and when a position change of the developer image forming unit in the main scanning direction is detected, adjust the correction data by a detected position change amount.

BRIEF DESCRIPTION OF THE DRAWINGS

Exemplary embodiment(s) of the present disclosure will be described in detail based on the following figures, wherein.

DETAILED DESCRIPTION

Next, exemplary embodiments of the present disclosure will be described in detail with reference to the drawings.

Figure 1:
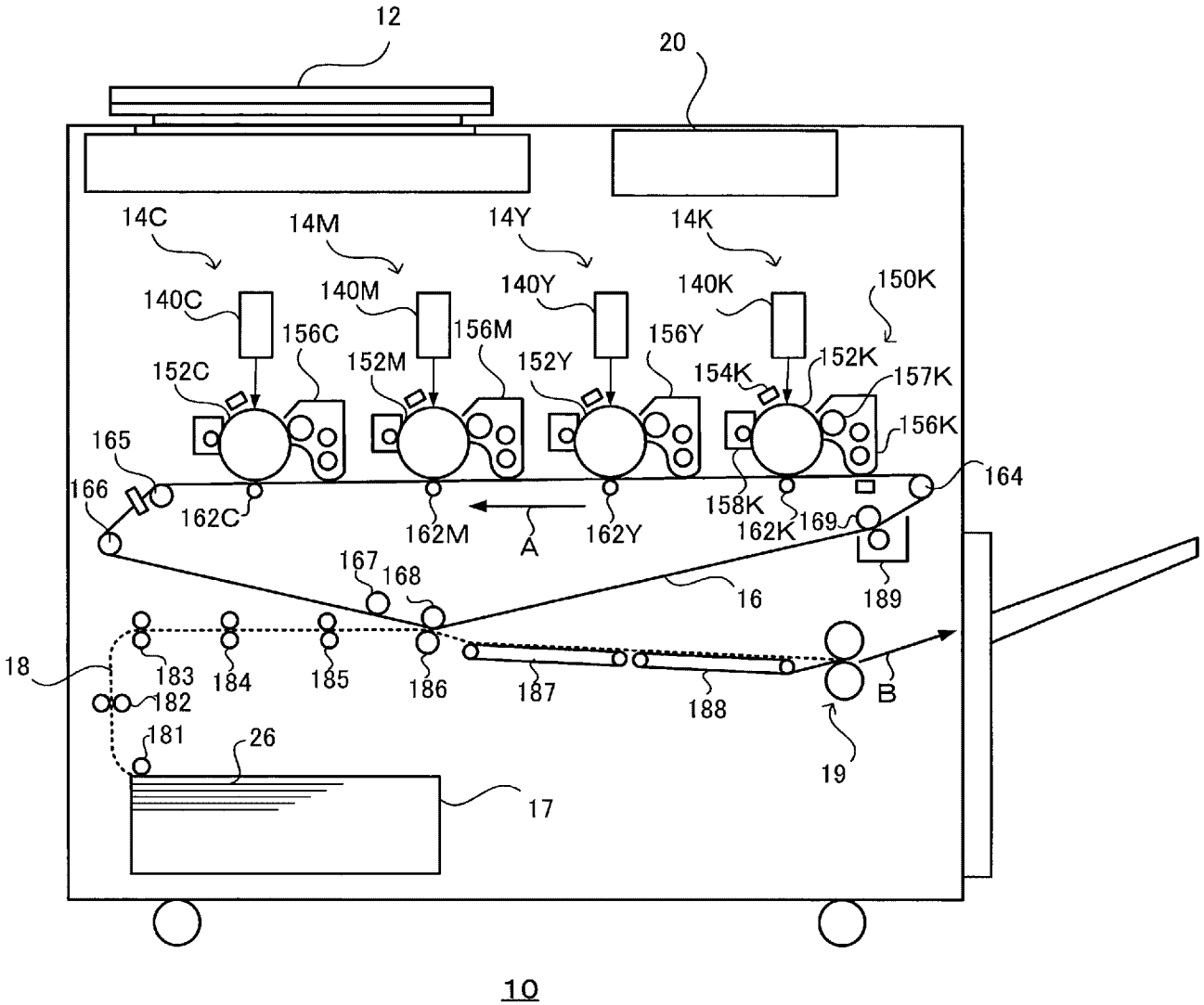
FIG. 1 is a diagram illustrating a configuration of an image forming apparatus 10 according to an exemplary embodiment of the present disclosure.

FIG. 1 is a diagram illustrating a configuration of an image forming apparatus 10 according to an exemplary embodiment of the present disclosure.

As illustrated in FIG. 1, the image forming apparatus 10 includes an image reader 12, image forming units 14C, 14M, 14Y, and 14K, an intermediate transfer belt 16, a sheet tray 17, a sheet transport path 18, a fixing device 19, and a controller 20. The image forming apparatus 10 is a multi-function device having a printer function of printing image data received from a personal computer (not illustrated) or the like, a function as a full-color copier using the image reader 12, and a function as a facsimile.

The image reader 12 and the controller 20 are provided in an upper portion of the image forming apparatus 10. The image reader 12 and the controller 20 function as an input unit that inputs the image data. The image reader 12 reads an image on a document and outputs the image to the controller 20. The controller 20 performs image processing such as a tone correction and a resolution correction on the image data input from the image reader 12 or the image data input from the personal computer (not illustrated) or the like via a network line such as a LAN, and outputs the image data to the image forming units 14.

The four image forming units 14C, 14M, 14Y, and 14K corresponding to colors constituting a color image are provided below the image reader 12. In the present exemplary embodiment, the four image forming units 14K, 14Y, 14M, and 14C corresponding to colors of black (K), yellow (Y), magenta (M), and cyan (C) are horizontally arranged along the intermediate transfer belt 16 at regular intervals. The intermediate transfer belt 16 rotates in a direction of an arrow A in FIG. 1. The intermediate transfer body 16 may serve as an intermediate transfer body. Then, the four image forming units 14K, 14Y, 14M, and 14C sequentially form toner images of the respective colors based on the image data input from the controller 20, and transfer (primarily transfer) the plural toner images onto the intermediate transfer belt 16 at timing when the toner images are superimposed on each other. An order of the colors of the image forming units 14K, 14Y, 14M, and 14C is not limited to black, yellow, magenta, and cyan, but may be any order such as an order of yellow, magenta, cyan, and black.

The sheet transport path 18 is provided below the intermediate transfer belt 16. A recording sheet 26 supplied from the sheet tray 17 is transported on the sheet transport path 18. The toner images of the respective colors, which are transferred onto the intermediate transfer belt 16 in a superimposed manner, are collectively transferred (secondarily transferred) to the recording sheet 26. The transferred toner images are fixed to the recording sheet 26 by the fixing device 19. Then, the recording sheet 26 is discharged to an outside along an arrow B.

Next, a configuration of each components of the image forming apparatus 10 will be described in more detail.

The image forming units 14K, 14Y, 14M, and 14C are arranged in parallel in a horizontal direction at the regular intervals. The image forming units 14K, 14Y, 14M, and 14C have substantially the same configuration except that the colors of the images to be formed are different from each other. Therefore, the image forming unit 14K will be described below. To distinguish the image forming units 14, suffixes K, Y, M, and C are added.

The image forming unit 14K includes an exposure device 140K and an image forming device 150K. The exposure device 140K scans a photoconductor drum 152 with laser light in accordance with the image data input from the controller 20 to expose the photoconductor drum 152. An electrostatic latent image is formed in the image forming apparatus 150K with the laser light from the exposure device 140K.

The exposure device 140K modulates the laser light according to black (K) image data, and irradiates a photoconductor drum 152K of the image forming device 150K with this laser light.

The image forming device 150K includes the photoconductor drum 152K, a charging device 154K, a developing device 156K, and a cleaning device 158K. The photoconductor drum 152K rotates at a predetermined rotation speed in the direction of the arrow A. The charging device 154K uniformly charges a surface of the photoconductor drum 152K. The charging device 154K may serve as a charger. The developing device 156K develops the electrostatic latent image formed on the photoconductor drum 152K. The photoconductor drum 152K is a cylindrical image carrier that carries a toner image. The photoconductor drum 152K is uniformly charged by the charging device 154K, and the electrostatic latent image is formed with the laser light emitted from the exposure device 140K. The electrostatic latent image formed on the photoconductor drum 152K is developed by the developing device 156K with black (K) toner and transferred onto the intermediate transfer belt 16. Residual toner, paper dust and the like adhering to the photoconductor drum 152K after the transferring step of the toner image are removed by the cleaning device 158K.

Similarly, the other image forming units 14Y, 14M and 14C also include photoconductor drums 152Y, 152M and 152C and developing devices 156Y, 156M and 156C, respectively. The image forming units 14Y, 14M and 14C form toner images of the respective colors of yellow (Y), magenta (M), and cyan (C), and transfer the formed toner images of the respective colors onto the intermediate transfer belt 16. The intermediate transfer belt 16 is an example of the intermediate transfer body.

As described above, the photoconductor drums 152K, 152Y, 152M, and 152C function as image carriers that carry the toner images of the respective colors of C, M, Y, and K, respectively.

The intermediate transfer belt 16 is formed in an endless belt shape. The intermediate transfer belt 16 is wound around a drive roller 164, idle rollers 165, 166, 167, a backup roller 168, and an idle roller 169 with a constant tension. The intermediate transfer belt 16 is circularly driven in the direction of the arrow A at a predetermined speed by rotationally driving the drive roller 164 by a driving motor (not illustrated).

Primary transfer rollers 162K, 162Y, 162M, and 162C are disposed at positions where the primary transfer rollers 162K, 162Y, 162M, and 162C face the image forming units 14K, 14Y, 14M and 14C, respectively. The toner images of the respective colors formed on the photoconductor drums 152K, 152Y, 152M, and 152C are transferred onto the intermediate transfer belt 16 in the superimposed manner by these primary transfer rollers 162. Residual toner adhering to the intermediate transfer belt 16 is removed by a cleaning blade or a brush of a belt cleaning device 189 provided downstream of a secondary transfer position.

The sheet transport path 18 includes a sheet feeding roller 181, a pair of first rollers 182, a pair of second rollers 183, a pair of third rollers 184, and registration rollers 185. The sheet feeding roller 181 picks the recording sheet 26 out of the sheet tray 17. The first rollers 182, the second rollers 183, and the third rollers 184 are used in sheet transport. The registration rollers 185 transport the recording sheet 26 to the secondary transfer position at a predetermined timing.

A secondary transfer roller 186 that is in pressure contact with the backup roller 168 is provided at the secondary transfer position on the sheet transport path 18. The toner images of the respective colors, which are transferred onto the intermediate transfer belt 16 in the superimposed manner, are secondarily transferred onto the recording sheet 26 by a pressure contact force and an electrostatic force of the secondary transfer roller 186.

Then, the recording sheet 26 to which the toner images of the respective colors are transferred is transported to the fixing device 19 by a transport belt 187 and a transport belt 188.

The fixing device 19 melts and fixes toner onto the recording sheet 26 by performing a heat treatment and a pressure treatment on the recording sheet 26 onto which the toner images of the respective colors are transferred.

The developing device 156K includes a cylindrical developing roller 157K that transports a developer to the photoconductor drum 152K by rotating to form a developer image on the photoconductor drum 152K. Similarly, in the image forming units 14C, 14M, and 14Y that form the images of the other colors, developing rollers are provided in the developing devices 156C, 156M, and 156Y, respectively.

Figure 2:
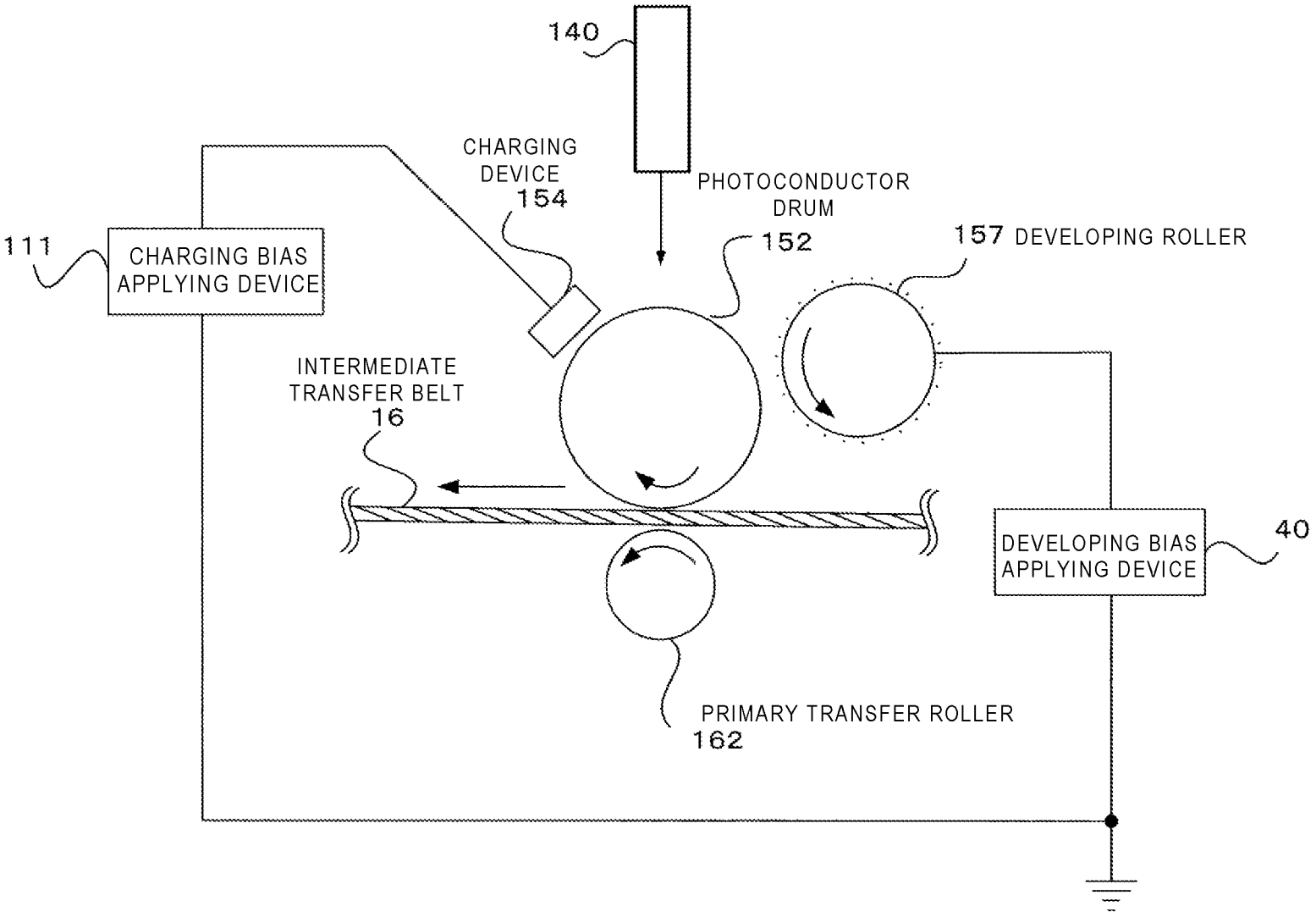
FIG. 2 is an enlarged view illustrating a positional relationship between a photoconductor drum 152 and a developing roller 157 in the image forming apparatus according to the exemplary embodiment of the present disclosure.

Next, FIG. 2 is an enlarged view illustrating a positional relationship between the photoconductor drum 152 and the developing roller 157 in the image forming apparatus 10 according to the present exemplary embodiment. FIG. 2 illustrates a common configuration to the respective colors without limiting colors of the toner.

As can be seen with reference to FIG. 2, the photoconductor drum 152 and the primary transfer roller 162 face each other with the intermediate transfer belt 16 interposed therebetween. The photoconductor drum 152 is an example of an image carrier that carries the toner image. The toner image is an example of the developer image. Then, the photoconductor drum 152 and the developing roller 157 face each other with a certain gap. The developing roller 157 carries developer on its surface by a magnetic force of magnets provided in the developing roller 157 and rotates to transport the carried developer to the gap between the photoconductor drum 152 and the developing roller 157, so that the developing roller 157 visualizes a latent image formed on the surface of the photoconductor drum 152. That is, the developing roller 157 forms the toner image by transporting the toner to the latent image formed on the photoconductor drum 152 by exposing the photoconductor drum 152 by an exposure device 140. The developing roller 157 may serves as a developer image forming unit. The toner is the developer.

The photoconductor drum 152 includes the charging device 154 that charges the surface of the photoconductor drum 152. The image forming apparatus 10 according to the present exemplary embodiment further includes a developing bias applying device 40 and a charging bias applying device 111.

The charging bias applying device 111 applies a charging bias voltage to the charging device 154.

The developing bias applying device 40 applies a developing bias voltage to the developing roller 157. The developing bias voltage is a voltage for moving the toner from the developing roller 157 to the photoconductor drum 152.

Next, a structure of the developing roller 157 illustrated in FIG. 2 will be described with reference to FIG. 3. In the present exemplary embodiment, a description will be made on the assumption that a development is performed using a two-component developer containing the toner and a carrier. Therefore, the developing roller 157 includes magnets 51 and 52 that generate a magnetic field, inside. The developing roller 157 may serve as a developer image forming unit. The magnets 51 and 52 may serve as a magnetic field generator.

Figure 3:
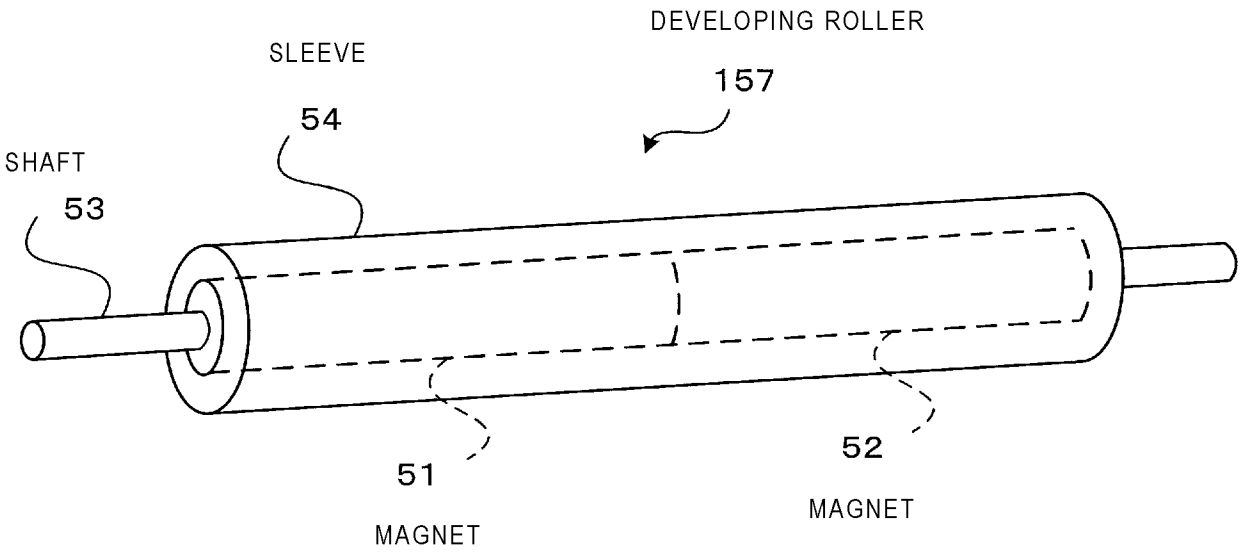
FIG. 3 is a diagram illustrating a structure of the developing roller 157 illustrated in FIG. 2.

FIG. 3 is a perspective view of the developing roller 157. The developing roller 157 includes a shaft 53, a cylindrical sleeve 54, and the two magnets 51 and 52. The cylindrical sleeve 54 is made of a metal such as aluminum or stainless steel.

Here, the image forming apparatus 10 of the present exemplary embodiment is a wide-format multifunction device capable of printing, for example, an AO size large format drawing. A length of the developing roller 157 is 90 to 100 cm, which is longer than that of a normal multifunction device. It is generally difficult to magnetize and fabricate a long magnet. Therefore, the developing roller 157 is configured by connecting the two magnets 51 and 52.

When the magnet is divided in the developing roller 157 as described above, it is difficult to completely prevent a magnetic field leakage at a connection portion between the magnets, so that the magnetic field may be non-uniform. When the toner is not uniformly transported during the developing of the latent image on the photoconductor drum 152 due to the non-uniformity of the magnetic field on the developing roller 157 as described above, the concentration unevenness in a toner concentration occurs. When such density unevenness occurs, there arises a problem that even if an image having the same density is to be formed, an area where the magnetic field is non-uniform has a different density from the other areas, and the density unevenness is visualized as a vertical streak.

Even when the developing roller 157 is implemented by only one magnet without connecting plural magnets to constitute the developing roller 157, if there is magnetized unevenness in the magnet, similarly, a generated magnetic field is non-uniform and the same problem arises. In particular, it is more difficult to fabricate a magnet in a uniform magnetized state as a length of the magnet is longer. Therefore, such the problem of the non-uniformity of the magnetic field arises more remarkably as the length of the developing roller 157 is longer.

Figure 4:
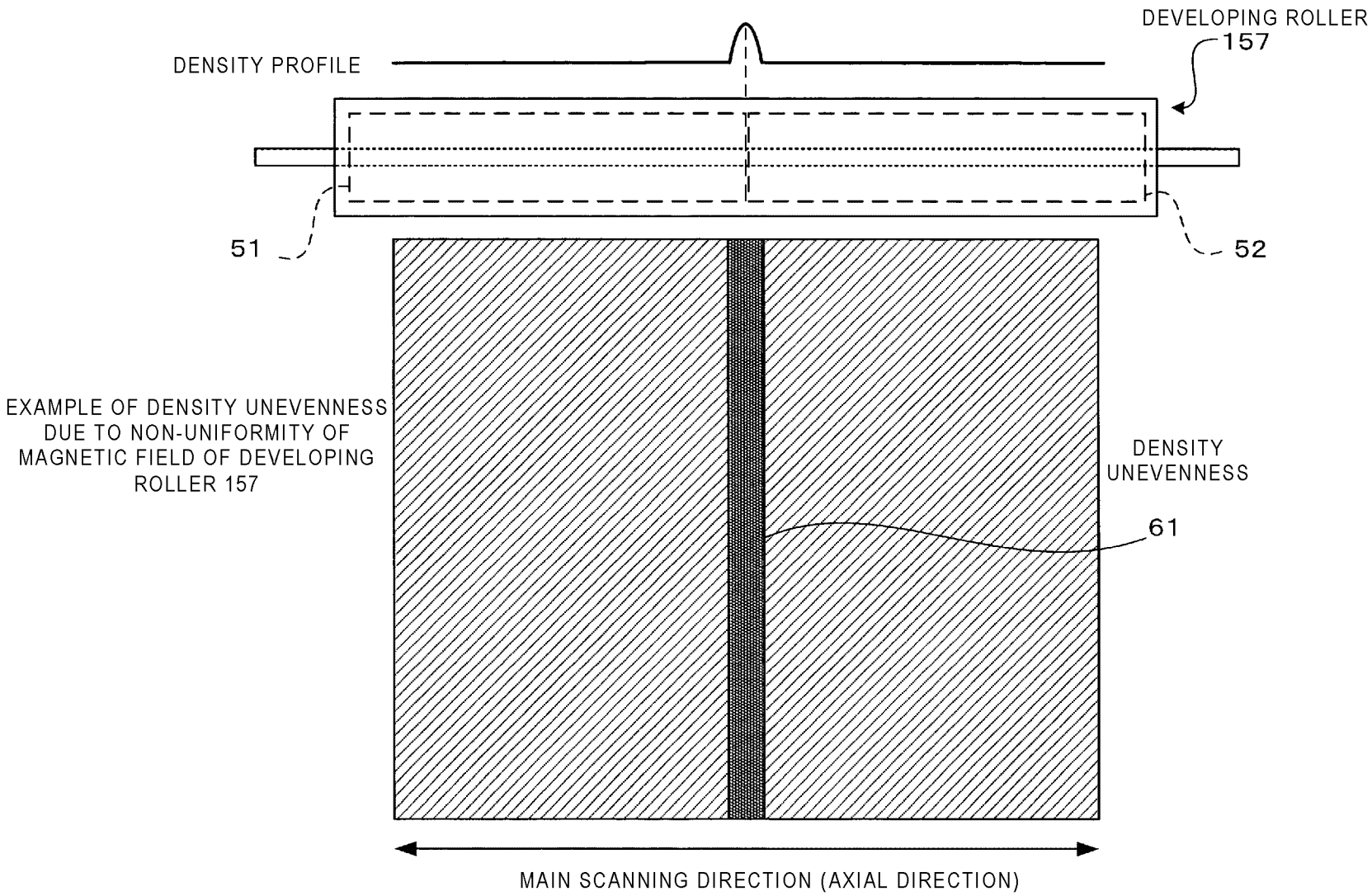
FIG. 4 is a diagram illustrating a situation in which a vertical streak occurs in an image.

Next, FIG. 4 illustrates a situation in which the vertical streak occurs in the image because of the reason described above. It is assumed that in FIG. 4, the density unevenness occurs in the developing roller 157 due to the non-uniformity of the magnetic field at the connection portion between the two magnets 51 and 52, and the density is high at the connection portion. Therefore, it can be seen that density unevenness 61 occurs in a main scanning direction, that is, an axial direction at a center of a formed image, and constitutes the vertical streak. Here, the term "main scanning direction" refers to a direction in which the exposure device 140 scans with the laser light.

When a density profile in the main scanning direction of the image in which such density unevenness 61 occurs is created, as illustrated in FIG. 4, a pattern is obtained which has a peak. A central portion of a peak has a higher value than other areas.

As a method for preventing such density unevenness, an exposure amount in the exposure device 140 may be changed to correct the density unevenness. Specifically, as illustrated in FIG. 5, a correction parameter having a pattern opposite to the density profile may be generated, and the exposure amount is changed based on the correction parameter to correct the density unevenness.

Figure 5:
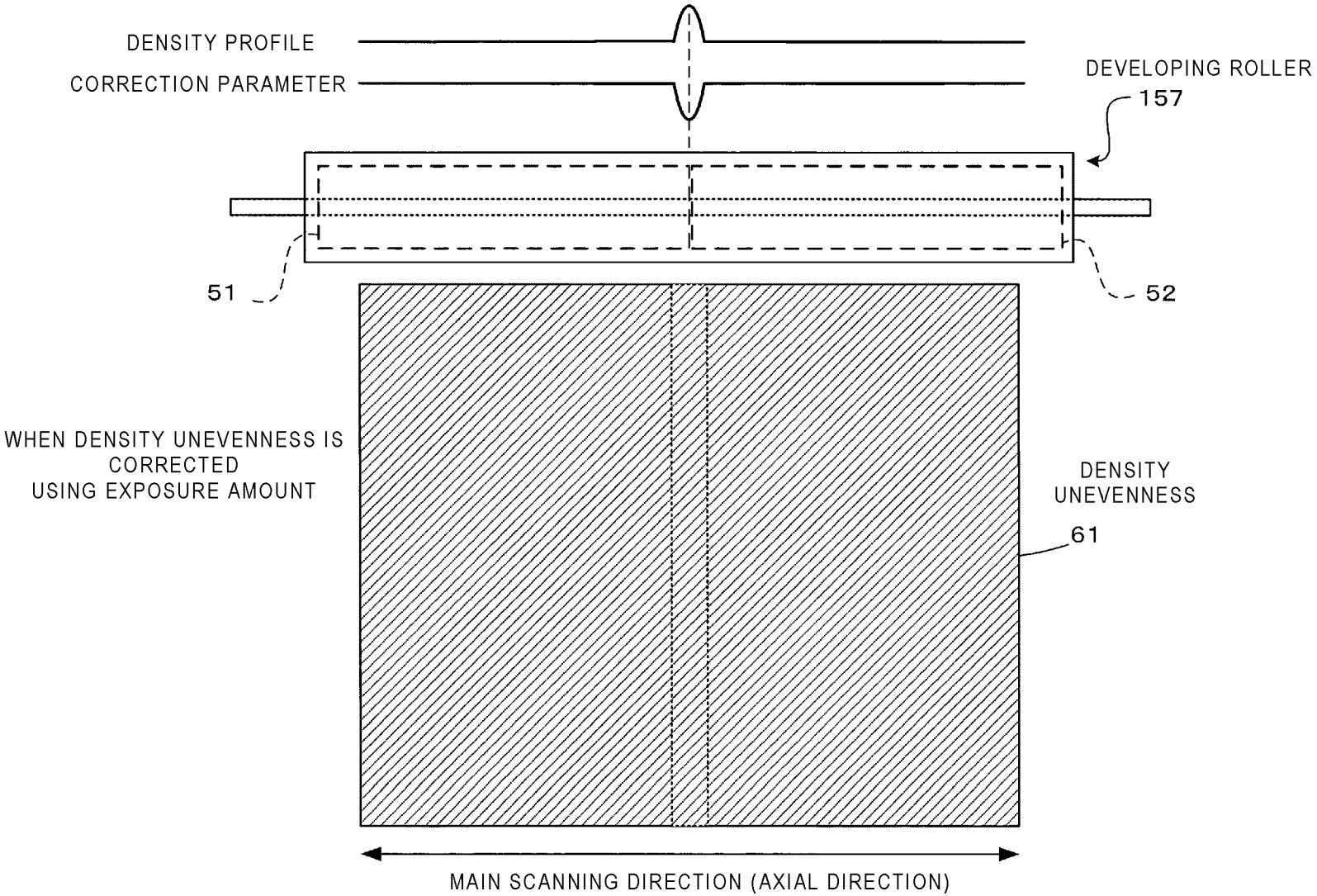
FIG. 5 is a diagram illustrating a situation in which density unevenness is corrected by changing an exposure amount based on a correction parameter.

With reference to FIG. 5, it can be seen that the density unevenness 61 is alleviated by controlling the exposure amount of the exposure device 140 based on the correction parameter having the pattern opposite to the density profile.

For each of the image forming units 14C, 14M, 14Y, and 14K of the respective colors of cyan, magenta, yellow, and black, the density unevenness is corrected in the above described manner. Thus, the correction parameter is also generated for each color.

Figure 6:
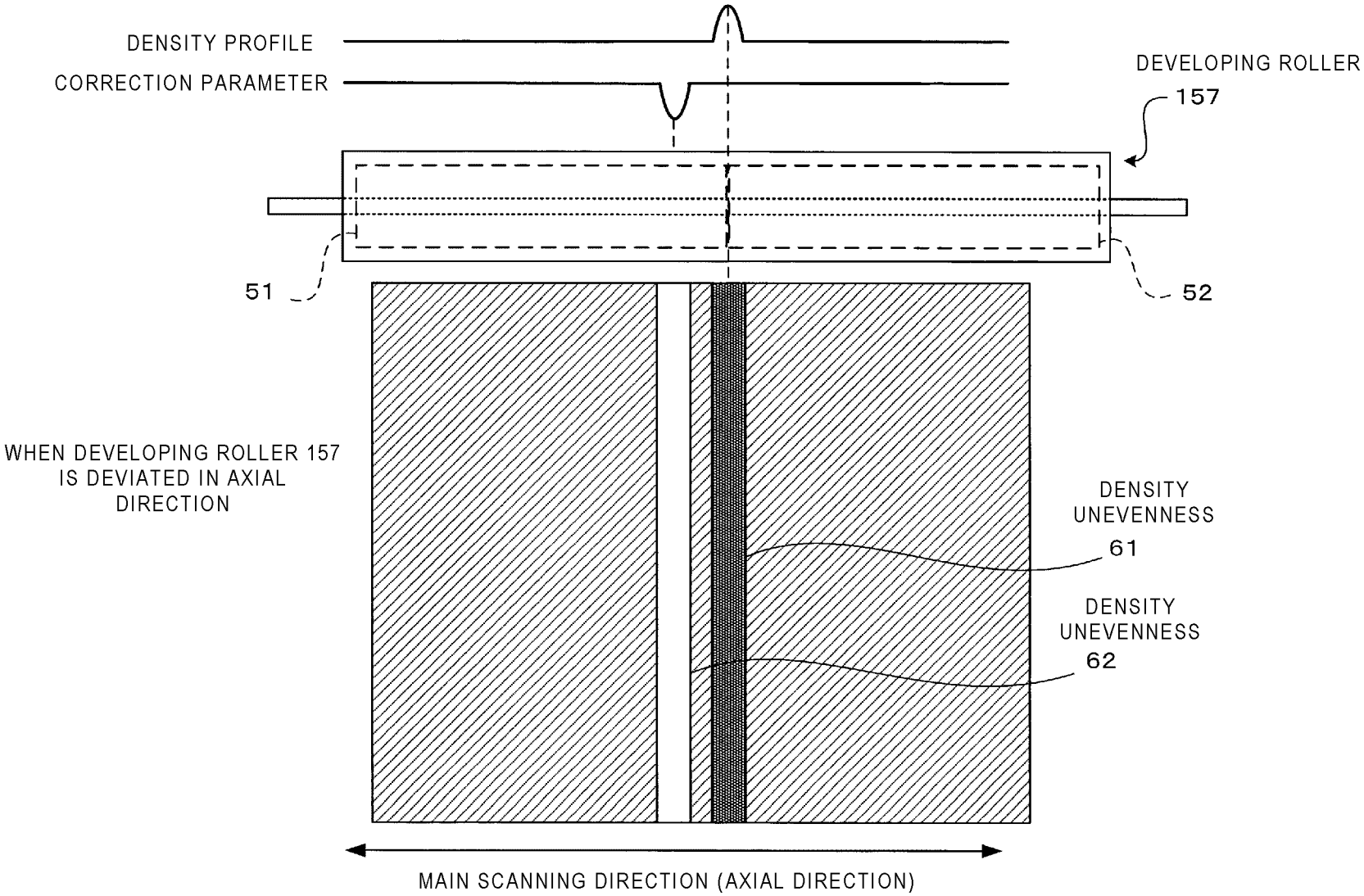
FIG. 6 is a diagram illustrating a situation in which the density unevenness is corrected using the correction parameter in a state where a position of the developing roller 157 is deviated in an axial direction.

When such density unevenness is corrected in a state where a position of the developing roller 157 is deviated in the axial direction, a problem arises. FIG. 6 illustrates a situation in which the position of the developing roller 157 is deviated in the axial direction while the density unevenness is corrected.

With reference to FIG. 6, it can be seen that the density profile is changed because the position of the developing roller 157 is deviated to a right direction in the drawing. Therefore, the density profile and the correction parameter are offset, the density unevenness 61 is not eliminated, but new density unevenness 62 occurs. Therefore, density unevenness at two locations that is, the density unevenness 61 and the density unevenness 62 occur in the formed image. Here, the density unevenness 62 occurs due to changing the exposure amount based on the correction parameter.

When the position of the developing roller 157 is deviated while the density unevenness is corrected by changing the exposure amount of the exposure device 140 as described above, the density unevenness is contrarily conspicuous.

Therefore, the image forming apparatus 10 of the present exemplary embodiment is configured as described below, so that even when the exposure amount of the exposure device 140 is changed to correct the density unevenness in the main scanning direction in the toner image formed on the photoconductor drum 152 in a state where the position of the developing roller 157 is deviated in the main scanning direction, it is possible to prevent a situation in which the density unevenness in the toner image and a change in the exposure amount do not match.

Figure 7:
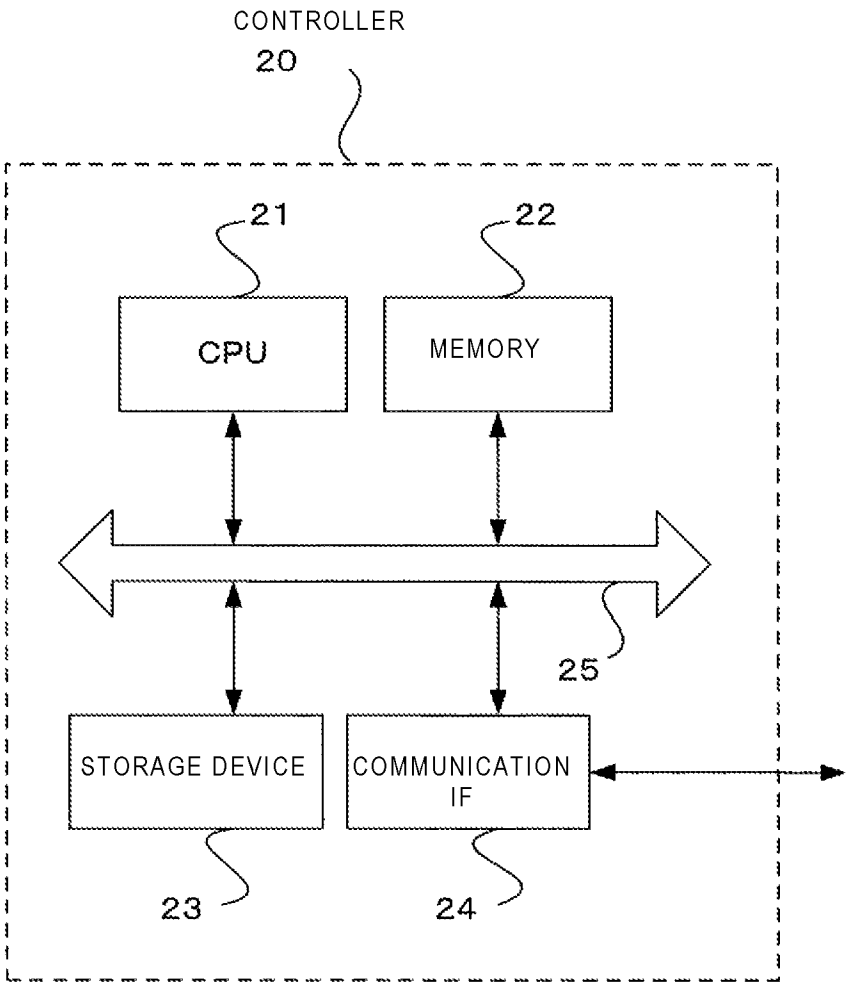
FIG. 7 is a diagram illustrating a hardware configuration of a controller 20 illustrated in FIG. 1.

First, a hardware configuration of the controller 20 illustrated in FIG. 1 will be described with reference to FIG. 7. As illustrated in FIG. 7, the controller 20 includes a CPU 21, a memory 22, a storage device 23 such as a hard disk drive, a communication interface (abbreviated as IF) 24 that transmits and receives data to and from an external device. These components are connected to each other via a control bus 25.

The CPU 21 is a processor that executes predetermined process based on a control program stored in the memory 22 or the storage device 23 to control operation of the image forming apparatus 10. In the present exemplary embodiment, it is assumed that the CPU 21 is one that reads and executes the control program stored in the memory 22 or the storage device 23. It is noted that the control program may be stored in a storage medium such as a CD-ROM and provided to the CPU 21.

Figure 8:
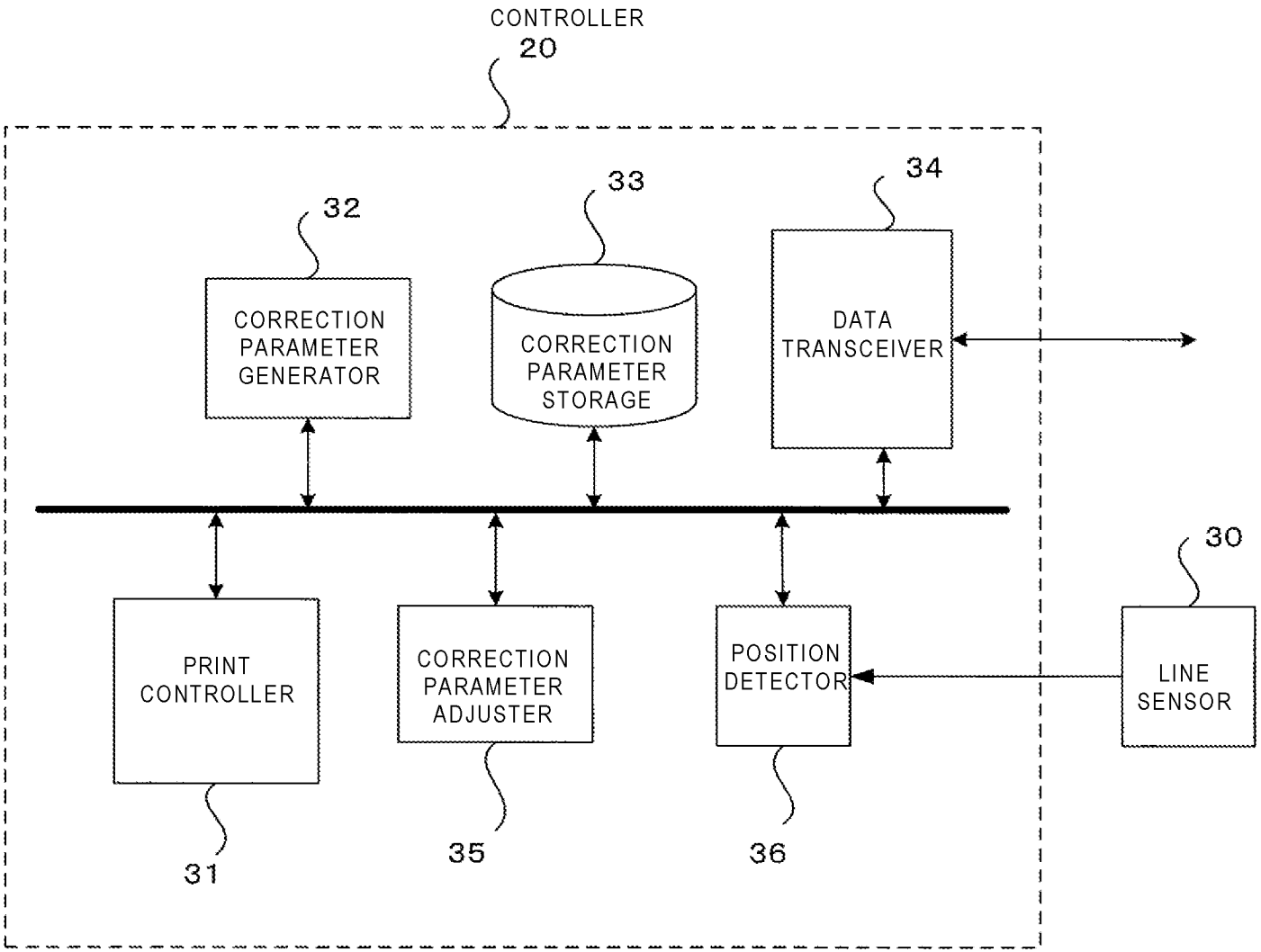
FIG. 8 is a block diagram illustrating a functional configuration of the controller 20 illustrated in FIG. 1.

FIG. 8 is a block diagram illustrating a functional configuration of the controller 20 implemented by executing the control program.

As illustrated in FIG. 8, the controller 20 includes a print controller 31, a correction parameter generator 32, a correction parameter storage 33, a data transceiver 34, a correction parameter adjuster 35, and a position detector 36.

The correction parameter generator 32 generates, as the correction parameter, correction data for correcting the density unevenness in the main scanning direction detected based on an image generated by the toner image formed on the photoconductor drum 152 by the developing roller 157.

The developing roller 157 in the present exemplary embodiment includes the two magnets 51 and 52. The magnetic field is non-uniform at the connection portion between the magnets 51 and 52. Therefore, the correction parameter generator 32 generates the correction parameter for correcting the density unevenness in the toner image caused by the non-uniformity of the magnetic field of the developing roller 157 in the main scanning direction. Specifically, the correction parameter generator 32 generates the correction parameter for correcting the density unevenness in the toner image caused by the non-uniformity of the magnetic field of the developing roller 157 in the main scanning direction, which occurs at the connection portion between the magnets 51 and 52.

The correction parameter storage 33 stores the correction parameter generated by the correction parameter generator 32.

The data transceiver 34 transmits and receives data to and from the image forming unit 14 and other components in the image forming apparatus 10.

The print controller 31 controls each component and executes a printing process by transmitting and receiving control signals to and from the image forming unit 14 and the like via the data transceiver 34.

Then, the print controller 31 changes the exposure amount at which the exposure device 140 exposes the photoconductor drum 152 using the correction parameter, which is generated by the correction parameter generator 32 and stored in the correction parameter storage 33, to thereby correct the density unevenness in the main scanning direction occurring in the toner image.

The position detector 36 detects a position change of the developing roller 157 in the main scanning direction, that is, in the axial direction at a preset timing or based on an instruction input by a user. Specifically, the position detector 36 uses, as a reference position, the position of the developing roller 157 when the correction parameter stored in the correction parameter storage 33 is generated, and detects the position change from this reference position.

The position detector 36 detects whether the position of the developing roller 157 is deviated, based on a detection signal from a line sensor 30 provided on the photoconductor drum 152.

When the position detector 36 detects whether the position of the developing roller 157 is deviated, first, the print controller 31 forms a toner image corresponding to a shape of the entire developing roller 157 on the photoconductor drum 152.

Then, the position detector 36 detects a position of an end portion of the toner image formed on the photoconductor drum 152 to thereby detect a position change of the developing roller 157 from the reference position in the main scanning direction as a positional deviation.

The print controller 31 forms the toner image corresponding to the shape of the entire developing roller 157 on the photoconductor drum 152 by entirely exposing an area corresponding to an entire area of the developing roller 157 by the exposure device 140 after the photoconductor drum 152 is charged by the charging device 154.

Alternatively, the print controller 31 may form the toner image corresponding to the shape of the entire developing roller 157 on the photoconductor drum 152 by charging the photoconductor drum 152 such that the photoconductor drum 152 has a voltage after the photoconductor drum 152 is exposed by the exposure device 140.

A specific method for detecting whether the position of the developing roller 157 is deviated will be described later.

When the position detector 36 detects the position change of the developing roller 157 in the main scanning direction, the correction parameter adjuster 35 adjusts the correction parameter stored in the correction parameter storage 33 by a detected position change amount. Specifically, the correction parameter adjuster 35 adjusts the correction parameter by shifting the correction parameter stored in the correction parameter storage 33 by the position change amount detected by the position detector 36.

Next, the operation of the image forming apparatus 10 according to the present exemplary embodiment will be described in detail with reference to the drawings.

Figure 9:
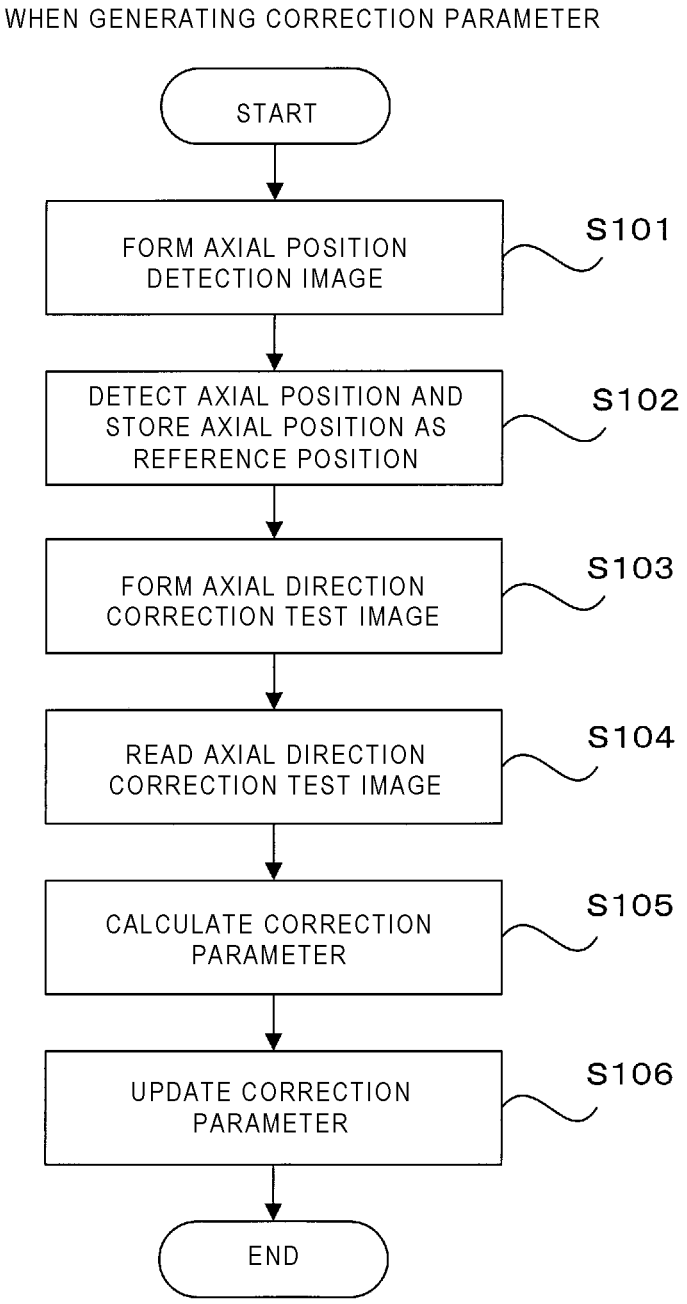
FIG. 9 is a flowchart of an operation of generating the correction parameter for correcting the density unevenness in a main scanning direction.

First, an operation of generating the correction parameter for correcting the density unevenness in the main scanning direction will be described with reference to a flowchart of FIG. 9.

First, in step S101, the print controller 31 forms the toner image corresponding to the shape of the entire developing roller 157 on the photoconductor drum 152 as an axial position detection image 80.

Figure 10:
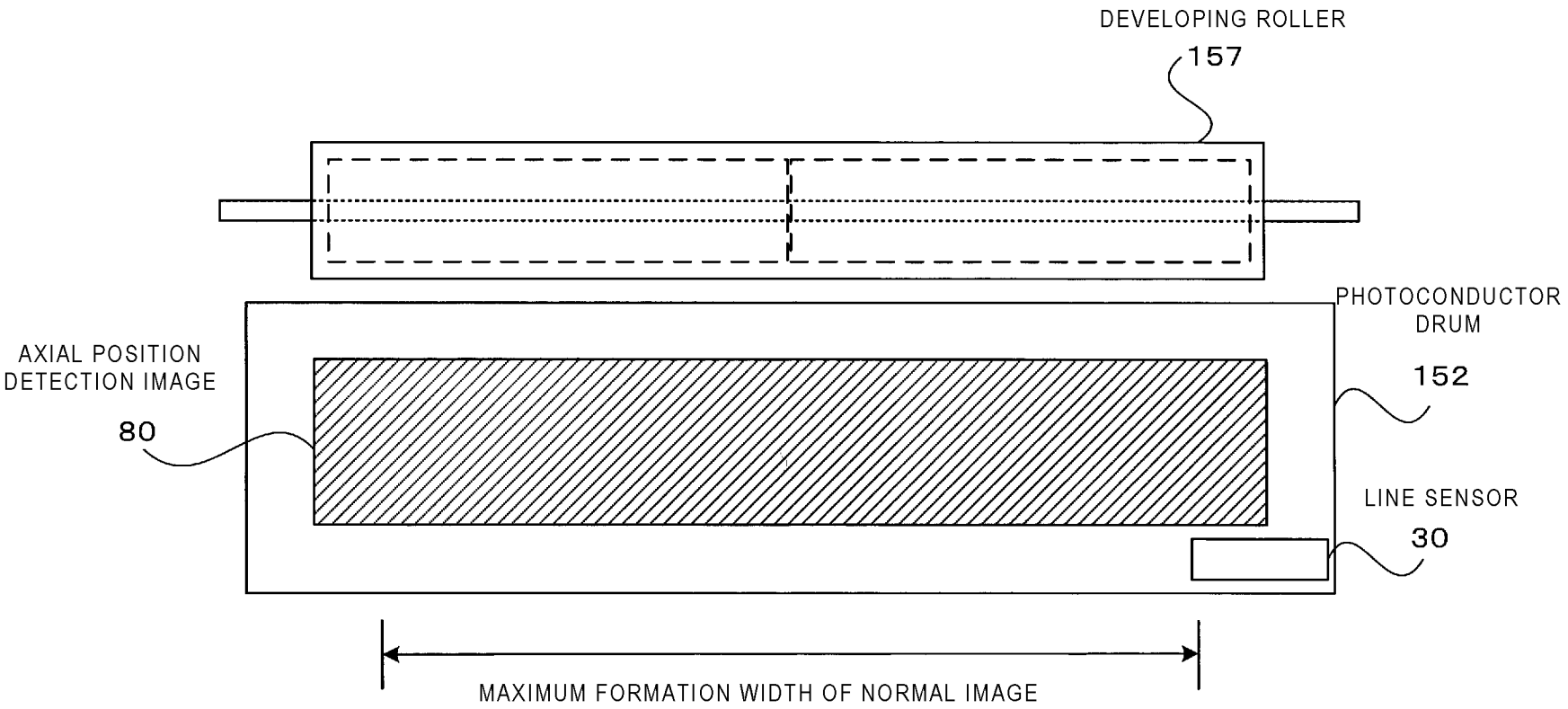
FIG. 10 is a diagram illustrating an example of an axial position detection image 80 formed on the photoconductor drum 152.

FIG. 10 illustrates an example of the axial position detection image 80 which is formed on the photoconductor drum 152 in the above manner.

With reference to FIG. 10, it can be seen that the toner image corresponding to the shape of the entire developing roller 157 is formed on the photoconductor drum 152 as the axial position detection image 80.

The line sensor 30 is provided on the photoconductor drum 152. The line sensor 30 can detect a position of an end portion of the axial position detection image 80.

The position detector 36 detects the position of the developing roller 157 based on the position of the end portion of the axial position detection image 80 detected by the line sensor 30.

In order to form such an axial position detection image 80 on the photoconductor drum 152 and detect whether the position of the developing roller 157 is deviated, it is necessary for the photoconductor drum 152 to have an effective area longer than an area that the developing roller 157 can develop.

As a matter of course, the maximum formation width of a normal image on a sheet is shorter than a lateral width of the developing roller 157.

Next, a specific method for forming the axial position detection image 80 on the photoconductor drum 152 will be described.

Prior to the description on the specific method, a relationship between a surface potential of the photoconductor drum 152 and a surface potential of the developing roller 157 will be described with reference to FIG. 11. In the following description, it is assumed that negatively charged toner is used and that the surface potentials of the photoconductor drum 152 and the developing roller 157 are negative. It is noted that the present disclosure is not limited to this assumption.

Figure 11:
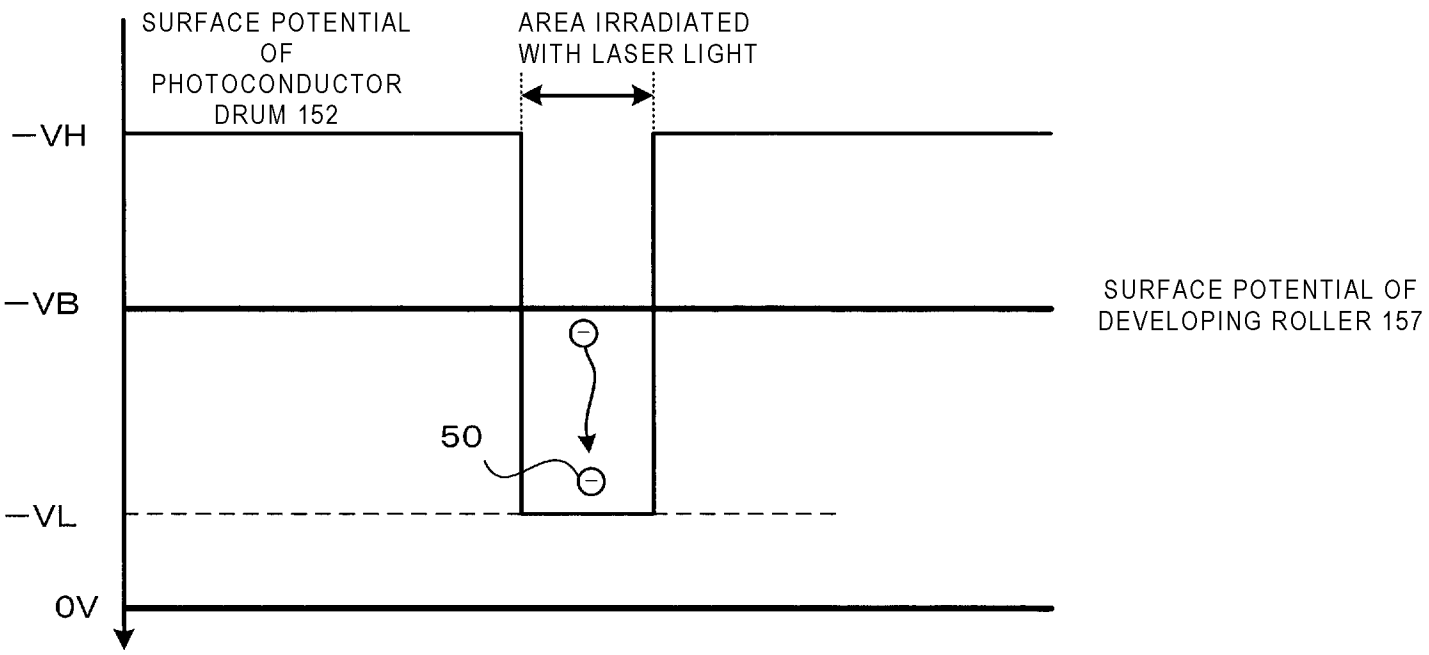
FIG. 11 is a diagram illustrating a relationship between a surface potential of the photoconductor drum 152 and a surface potential of the developing roller 157.

The photoconductor drum 152 is charged by the charging device 154 as illustrated in FIG. 2, so that the surface potential of the photoconductor drum 152 is −VH[V] as illustrated in FIG. 11. Then, an area where the latent image is formed by the exposure device 140 irradiating the area with the laser light has the surface potential of −VL[V] that is higher than −VH[V]. Then, when a developing bias voltage of −VB[V] is applied to the developing roller 157 by the developing bias applying device 40 illustrated in FIG. 2, the surface potential of the developing roller 157 is −VB[V]. Here, −VB is set to have a relationship of −VH[V]<−VB[V]<−VL[V]. Therefore, as illustrated in FIG. 11, the surface potential of −VB[V] of the developing roller 157 is higher than the surface potential of −VH[V] of the photoconductor drum 152 not irradiated with the laser light, but is lower than the surface potential of −VL[V] of the photoconductor drum 152 in the area irradiated with the laser light. Therefore, negatively charged toner 50 only moves from the developing roller 157 to the area of the photoconductor drum 152 irradiated with the laser light.

Thus, the toner 50 from the developing roller 157 moves only to the area of the photoconductor drum 152 where the latent image is formed, and the toner image is formed.

Figure 12A:
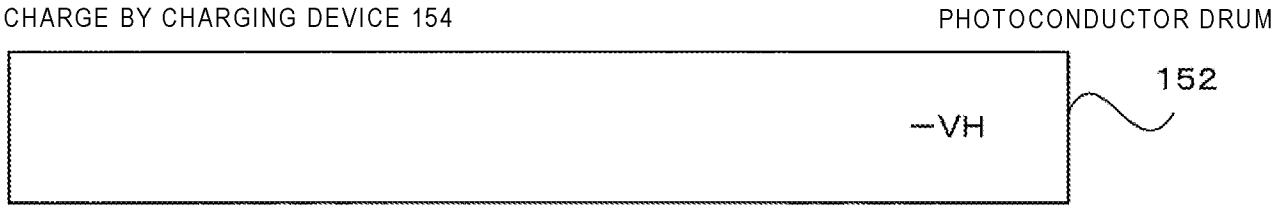
FIGS. 12A to 12C are diagrams illustrating a specific method as to how a print controller 31 forms the axial position detection image 80 on the photoconductor drum 152.
Figure 12B:
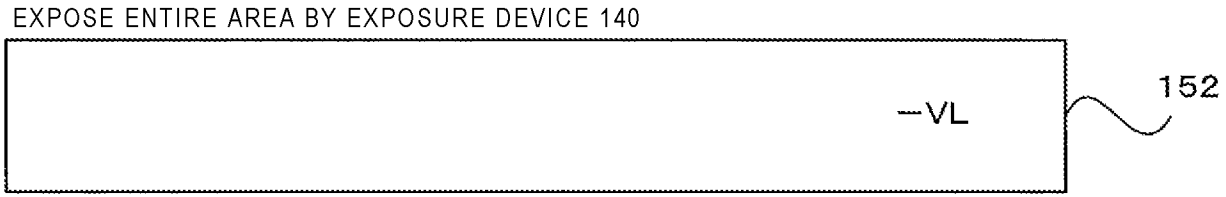
Figure 12C:
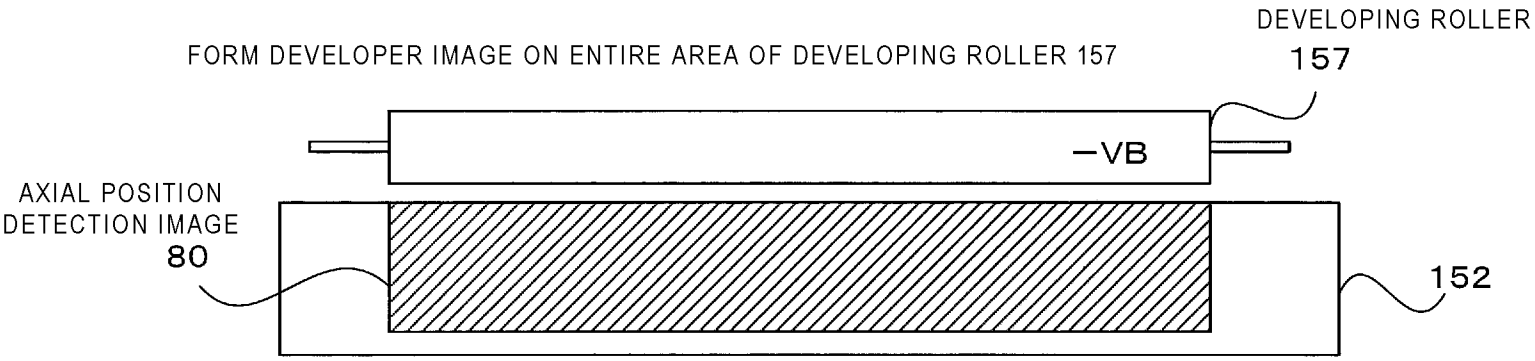

Next, FIGS. 12A to 12C illustrate a specific method as to how the print controller 31 forms the axial position detection image 80 described above on the photoconductor drum 152.

In the method illustrated in FIGS. 12A to 12C, first, the print controller 31 charges the entire photoconductor drum 152 to −VH[V] by the charging device 154, as illustrated in FIG. 12A.

Then, as illustrated in FIG. 12B, the print controller 31 sets the potential of the photoconductor drum 152 to −VL[V] by exposing the entire area of the photoconductor drum 152 by the exposure device 140.

Finally, as illustrated in FIG. 12C, by developing the photoconductor drum 152 in such a state by the developing roller 157, the print controller 31 forms the toner image corresponding to the shape of the entire developing roller 157 on the photoconductor drum 152 as the axial position detection image 80.

Figure 13A:
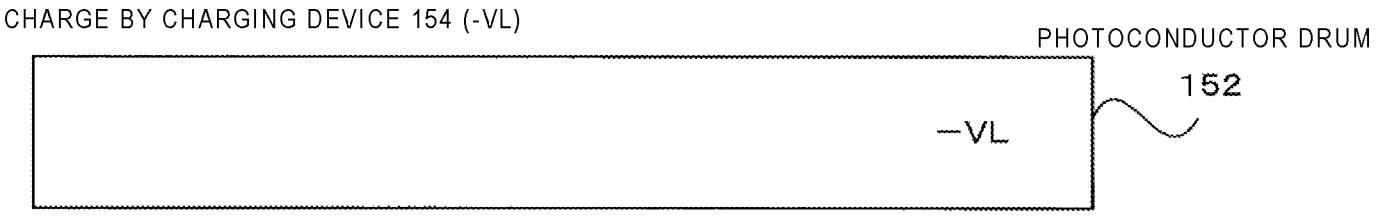
FIGS. 13A and 13B are diagrams illustrating another specific method as to how the print controller 31 forms the axial position detection image 80 on the photoconductor drum 152.
Figure 13B:
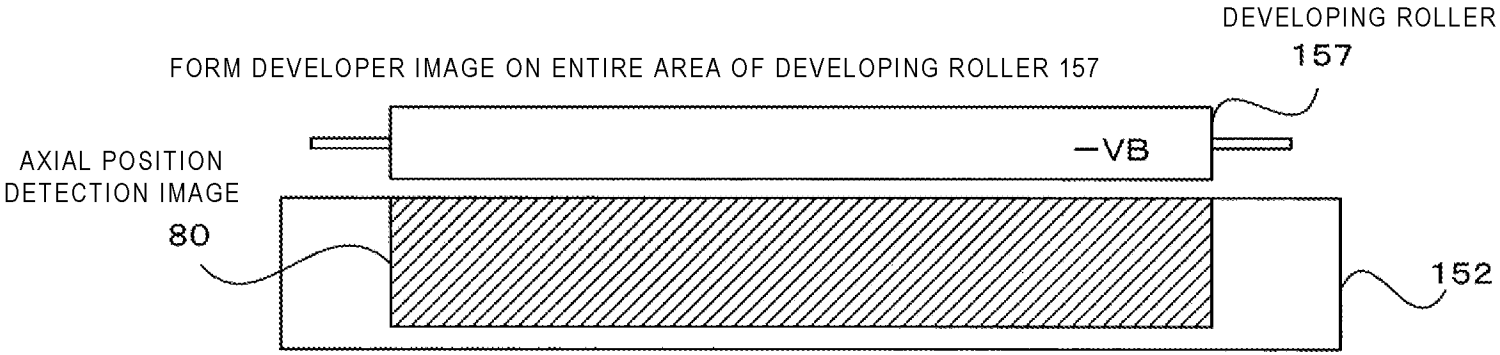

FIGS. 13A and 13B illustrate another specific method as to how the print controller 31 forms the axial position detection image 80 described above on the photoconductor drum 152.

In the method illustrated in FIGS. 13A and 13B, first, the print controller 31 charges the entire photoconductor drum 152 to −VL[V] by the charging device 154, as illustrated in FIG. 13A. −VL[V] is the voltage after the photoconductor drum 152 is exposed by the exposure device 140. That is, in the method illustrated in FIGS. 13A and 13B, the photoconductor drum 152 is charged to −VL[V] which is the same as the voltage after the exposure from the beginning rather than charging the photoconductor drum 152 to −VH[V] and then exposing the photoconductor drum 152 to −VL[V] by the exposure device 140.

Then, as illustrated in FIG. 13B, by developing the photoconductor drum 152 in such a state by the developing roller 157, the print controller 31 forms the toner image corresponding to the shape of the entire developing roller 157 on the photoconductor drum 152 as the axial position detection image 80.

According to the method illustrated in FIGS. 13A and 13B, as compared with the method illustrated in FIGS. 12A to 12C, the process of exposing the photoconductor drum 152 by the exposure device 140 is unnecessary.

After the axial position detection image 80 is formed on the photoconductor drum 152 in the above described manner, in step S102, the position detector 36 detects an axial position of the developing roller 157 by detecting the end portion of the axial position detection image 80, and stores the detected axial position as the reference position.

Next, the print controller 31 forms an axial direction correction test image in step S103. Then, the correction parameter generator 32 reads the formed axial direction correction test image in step S104, and generates the correction parameter based on the read axial direction correction test image in step S105.

Here, the correction parameter may be generated by forming the axial direction correction test image on the sheet and reading the axial direction correction test image on the sheet by the image reader 12. Alternatively, the correction parameter may be generated by reading a density in the axial direction of the axial direction correction test image formed on the photoconductor drum 152 by a sensor. A two-dimensional correction parameter may be generated in the main scanning direction and a sub-scanning direction by continuously reading the test image in a rotation direction of the developing roller 157.

Then, in step S106, the correction parameter generator 32 updates the correction parameter by storing the correction parameter thus generated in the correction parameter storage 33.

Figure 14:
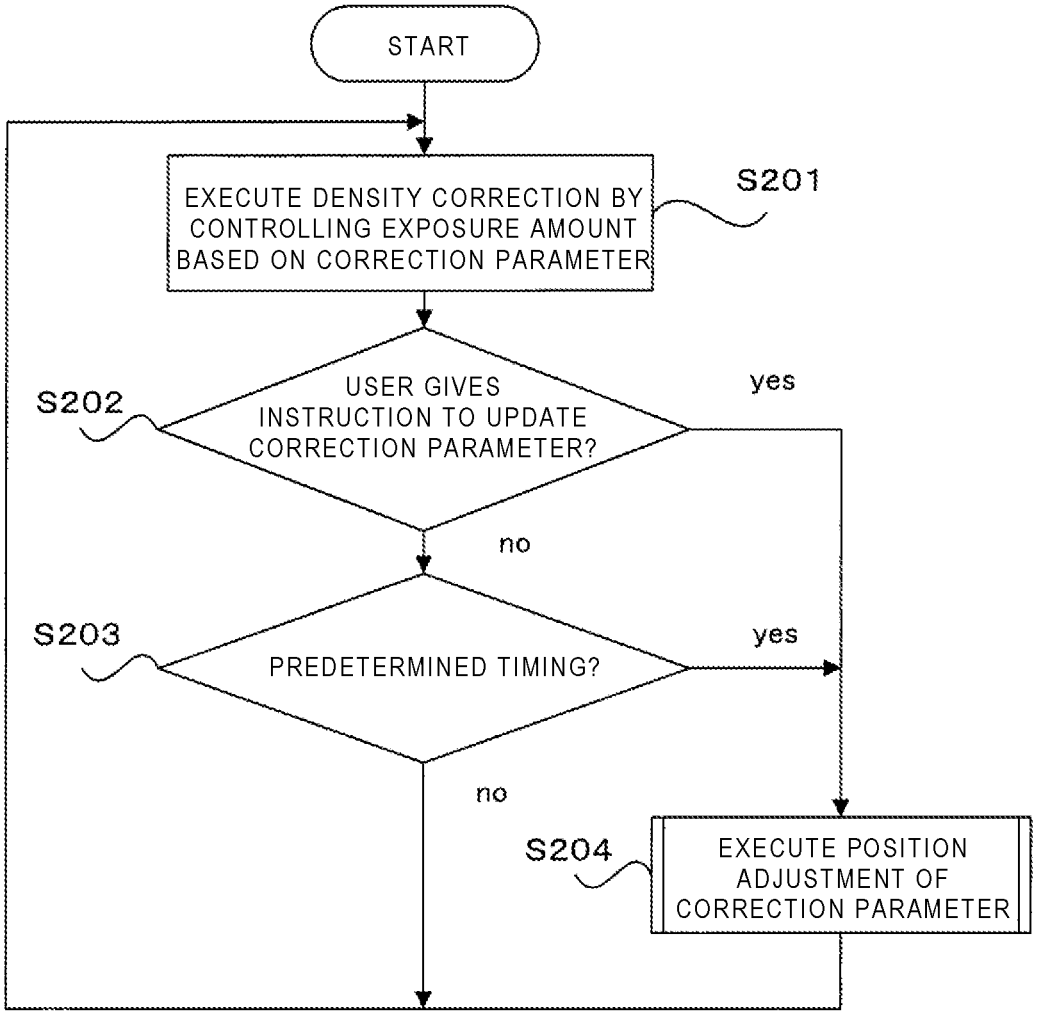
FIG. 14 is a flowchart of an operation of performing a density correction based on the correction parameter in forming an image.

Next, an operation of performing a density correction based on the correction parameter thus generated in forming an image will be described with reference to a flowchart of FIG. 14.

When forming the image on a recording medium such as the sheet, in step S201, the print controller 31 performs the density correction by reading the correction parameter stored in the correction parameter storage 33, and controlling the exposure amount of the exposure device 140 based on the read correction parameter.

Then, when the user does not give an instruction to update the correction parameter and no predetermined timing is reached, that is, when none of conditions in steps S202 and S203 is satisfied, the print controller 31 continues the density correction in step S201.

Then, when the user gives the instruction to update the correction parameter or the predetermined timing is reached, that is, when the conditions in either of steps S202 or S203 is satisfied, the print controller 31 performs a position adjustment for the correction parameter in step S204.

Here, various timings can be set as the predetermined timing, for example, when the preset number of sheets are printed, when an operating time exceeds a preset time, when a front door of the image forming apparatus 10 is opened and closed, when a member such as a toner cartridge is replaced, when a main power is once turned off and then turned on again, and the like.

Figure 15:
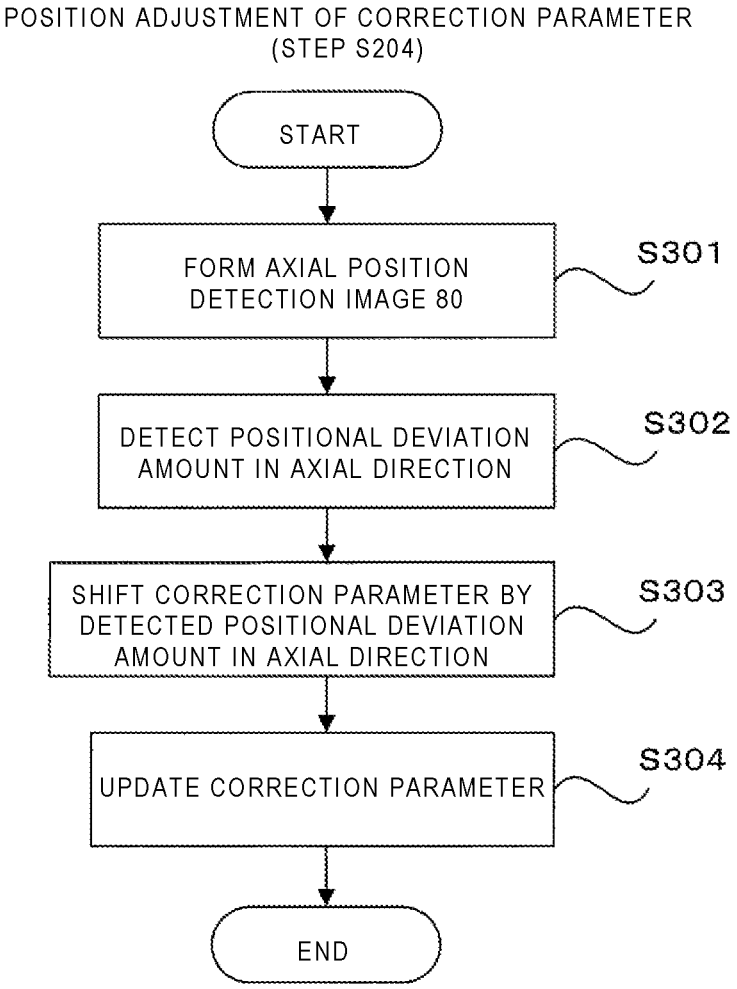
FIG. 15 is a flowchart of details of a position adjustment for the correction parameter illustrated in step S204 of the flowchart of FIG. 14.

Next, details of the position adjustment for the correction parameter illustrated in step S204 of the flowchart of FIG. 14 will be described with reference to a flowchart of FIG. 15.

First, when the position adjustment is performed for the correction parameter, in step S301, the print controller 31 forms the axial position detection image 80 on the photoconductor drum 152 by the method illustrated in FIGS. 12A to 12C or FIGS. 13A and 13B.

Then, in step S302, the position detector 36 detects the position of the end portion of the axial position detection image 80 formed on the photoconductor drum 152 based on the detection signal from the line sensor 30 and detects a change amount from the reference position that is detected in advance, as a positional deviation amount.

Then, in step S303, the correction parameter adjuster 35 shifts the correction parameter stored in the correction parameter storage 33 by the positional deviation amount detected in step S302. Then, in step S304, the correction parameter adjuster 35 updates the correction parameter by storing the correction parameter shifted by the positional deviation amount in the correction parameter storage 33.

A situation in which the position adjustment is performed for the correction parameter in this manner will be described with reference to FIG. 16.

Figure 16:
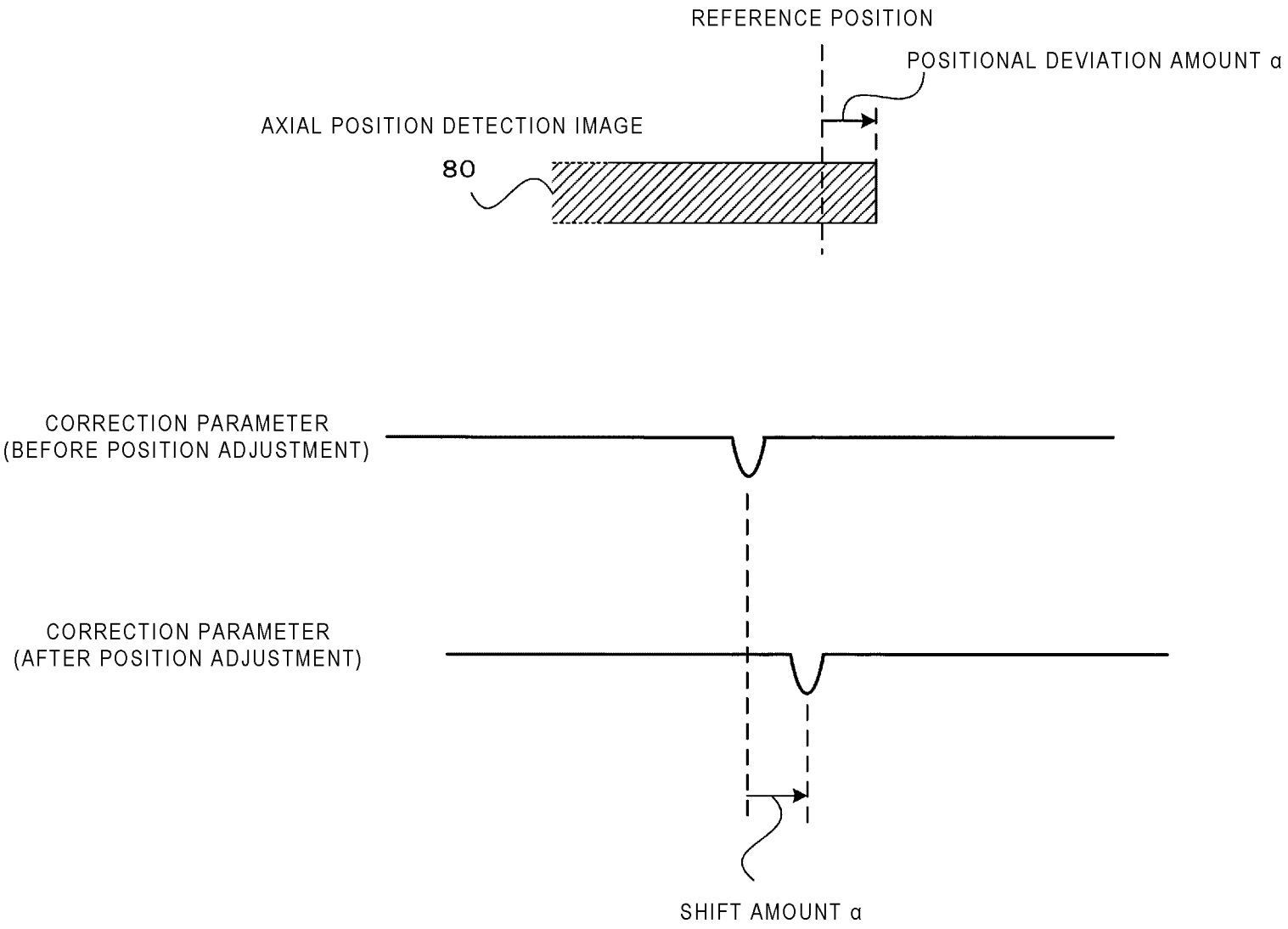
FIG. 16 is a diagram illustrating a situation in which the position adjustment is performed for the correction parameter.

With reference to FIG. 16, it can be seen that the change amount in the position of the end portion of the axial position detection image 80 from the reference position is detected as a positional deviation amount a. It also can be seen that the correction parameter before the position adjustment is shifted by the detected positional deviation amount a to become the correction parameter after the position adjustment.

Figure 17:
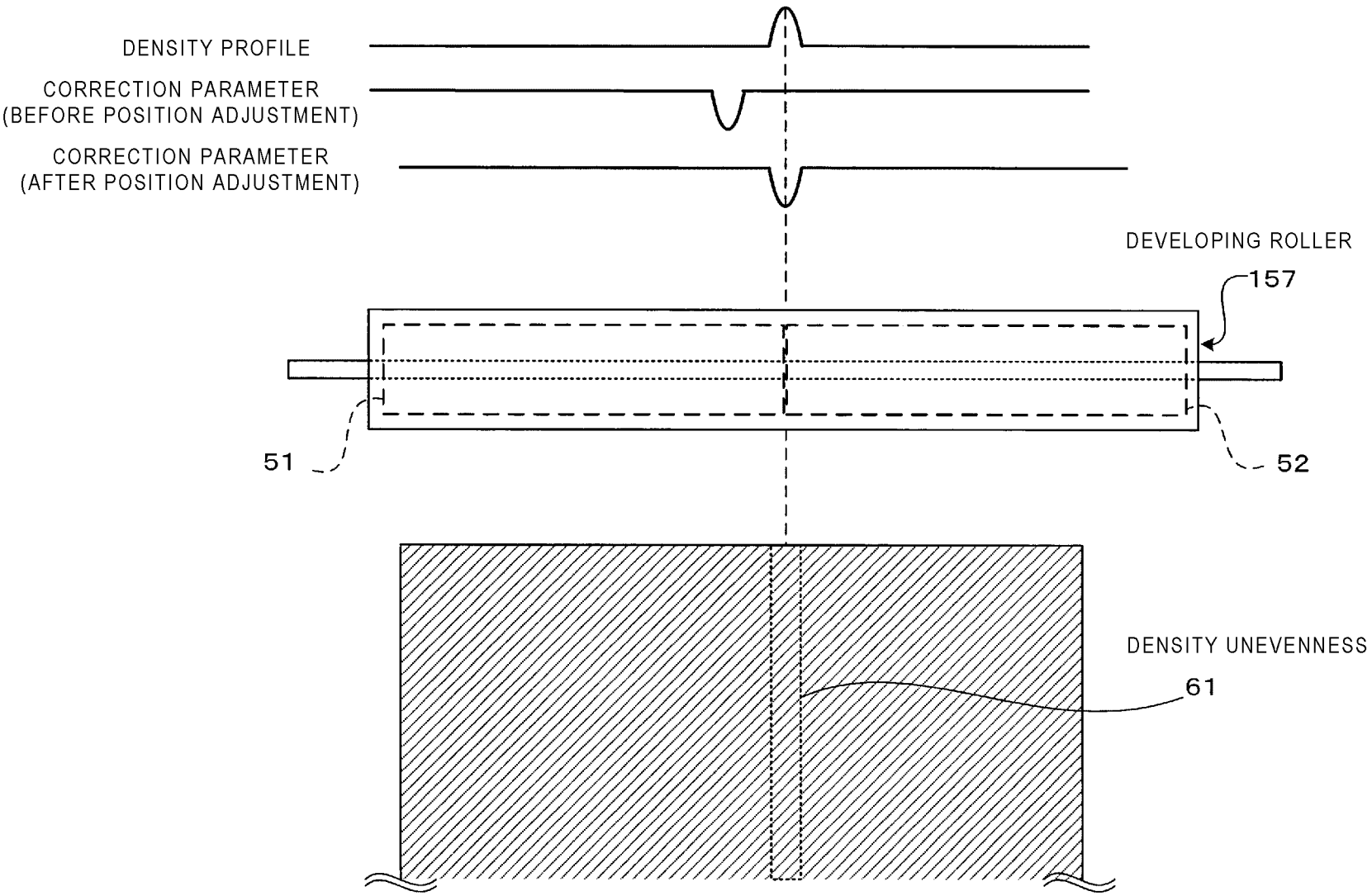
FIG. 17 is a diagram illustrating a situation in which the density correction is performed using the correction parameter for which the position adjustment has been performed.

Finally, FIG. 17 illustrates a situation in which the density correction is performed using the correction parameter for which the position adjustment has been performed in this manner.

With reference to FIG. 17, it can be seen that by performing the position adjustment for the correction parameter, a position of a density change in the density profile and a position in which the density correction is performed using the correction parameter match each other, and the density unevenness 61 occurring as the vertical streak in the formed image is alleviated.

In the embodiments above, the term "processor" refers to hardware in a broad sense. Examples of the processor includes general processors (e.g., CPU: Central Processing Unit), dedicated processors (e.g., GPU: Graphics Processing Unit, ASIC: Application Specific Integrated Circuit, FPGA: Field Programmable Gate Array, and programmable logic device).

In the embodiments above, the term "processor" is broad enough to encompass one processor or plural processors in collaboration which are located physically apart from each other but may work cooperatively. The order of operations of the processor is not limited to one described in the embodiments above, and may be changed.

Modification

In the above exemplary embodiment, the description has been made on an example where the present disclosure is applied to the wide-format multifunction device. It is noted that the present disclosure is not limited to this example, and is applicable to other image forming apparatuses such as a large-scale printing apparatus for business use.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

an image carrier configured to carry a developer image;

an exposure device configured to expose the image carrier;

a developer image forming unit configured to form the developer image by transporting a developer to a latent image formed on the image carrier by exposing the image carrier by the exposure device;

a sensor provided to detect a position change of the developer image forming unit;

a memory; and a processor configured to generate correction data for correcting density unevenness in a main scanning direction detected based on an image generated by the developer image formed on the image carrier by the developer image forming unit, correct the density unevenness in the main scanning direction occurring in the developer image by changing an exposure amount when the image carrier is exposed by the exposure device, using the generated correction data, and when the position change of the developer image forming unit in the main scanning direction is detected by the sensor, adjust the correction data by a detected position change amount, wherein:

the developer image forming unit comprises a magnetic field generator configured to generate a magnetic field, the processor is configured to generate the correction data for correcting the density unevenness in the developer image caused by non-uniformity of the magnetic field of the developer image forming unit in the main scanning direction, and the developer image forming unit is configured by connecting a plurality of magnetic field generators, and the processor generates the correction data for correcting the density unevenness in the developer image caused by the non-uniformity of the magnetic field of the developer image forming unit in the main scanning direction, the non-uniformity of the magnetic field occurring at a connection portion between the plurality of magnetic field generators.

2. The image forming apparatus according to claim 1, wherein the processor is configured to detect the position change of the developer image forming unit in the main scanning direction at a preset timing.

3. The image forming apparatus according to claim 1, wherein the processor is configured to detect the position change of the developer image forming unit in the main scanning direction based on an instruction input by a user.

4. The image forming apparatus according to claim 1, wherein the processor is configured to form a developer image corresponding to a shape of the entire developer image forming unit on the image carrier, and detect the position change of the developer image forming unit in the main scanning direction by detecting a position of an end portion of the developer image formed on the image carrier.

5. The image forming apparatus according to claim 4, wherein the processor is configured to form the developer image corresponding to the shape of the entire developer image forming unit on the image carrier by entirely exposing an area of the image carrier corresponding to an entire area of the developer image forming unit by the exposure device after the image carrier is charged, and detect the position change of the developer image forming unit in the main scanning direction by detecting the position of the end portion of the developer image formed on the image carrier.

6. The image forming apparatus according to claim 4, wherein the processor is configured to form the developer image corresponding to the shape of the entire developer image forming unit on the image carrier by charging the image carrier such that the image carrier has a voltage after the image carrier is exposed by the exposure device, and detect the position change of the developer image forming unit in the main scanning direction by detecting the position of the end portion of the developer image formed on the image carrier.

7. A non-transitory computer readable medium storing a program that causes a processor to execute information processing, the information processing comprising:

generating correction data for correcting density unevenness in a main scanning direction detected based on an image generated by a developer image formed on an image carrier by a developer image forming unit by transporting a developer to a latent image formed on the image carrier by exposing the image carrier by a exposure device;

correcting the density unevenness in the main scanning direction occurring in the developer image by changing an exposure amount when the image carrier is exposed by the exposure device, using the generated correction data, and when a position change of the developer image forming unit in the main scanning direction is detected, adjusting the correction data by a detected position change amount wherein:

the developer image forming unit comprises a magnetic field generator configured to generate a magnetic field, the information processing further generates the correction data for correcting the density unevenness in the developer image caused by non-uniformity of the magnetic field of the developer image forming unit in the main scanning direction, and the developer image forming unit is configured by connecting a plurality of magnetic field generators, and the information processing generates the correction data for correcting the density unevenness in the developer image caused by the non-uniformity of the magnetic field of the developer image forming unit in the main scanning direction, the non-uniformity of the magnetic field occurring at a connection portion between the plurality of magnetic field generators.

8. An image forming apparatus comprising:

image carrying means for carrying a developer image;

exposure means for exposing the image carrying means;

developer image forming means for forming the developer image by transporting a developer to a latent image formed on the image carrying means by exposing the image carrying means by the exposure means;

sensor means for detecting a position change of the developer image forming means; and means for generating correction data for correcting density unevenness in a main scanning direction detected based on an image generated by the developer image formed on the image carrying means by the developer image forming means, correcting the density unevenness in the main scanning direction occurring in the developer image by changing an exposure amount when the image carrying means is exposed by the exposure means, using the generated correction data, and when a position change of the developer image forming means in the main scanning direction is detected by the sensor means, adjusting the correction data by a detected position change amount, wherein:

the developer image forming means comprises a magnetic field generator configured to generate a magnetic field, the apparatus further comprises a means for generating the correction data for correcting the density unevenness in the developer image caused by non-uniformity of the magnetic field of the developer image forming unit in the main scanning direction, and the developer image forming means is configured by connecting a plurality of magnetic field generators, and the apparatus further comprises a means for generating the correction data for correcting the density unevenness in the developer image caused by the non-uniformity of the magnetic field of the developer image forming unit in the main scanning direction, the non-uniformity of the magnetic field occurring at a connection portion between the plurality of magnetic field generators.

* * * * *